United States Patent [19]

Morrone

[11] Patent Number: 4,922,553

[45] Date of Patent: May 8, 1990

[54] DECORATIVE SHIRT COLLAR SUPPORT DEVICE

[76] Inventor: James V. Morrone, 25 Sea Foam Ave., Winthrop, Mass. 02152

[21] Appl. No.: 249,520

[22] Filed: Sep. 26, 1988

[51] Int. Cl.[5] ..... A44D 3/00; A41D 27/08; A41D 27/16

[52] U.S. Cl. ..... 2/132; 2/129; 2/134; 2/141 A

[58] Field of Search ..... 2/132, 133, 134, 135, 2/136, 139, 141 R, 141 A, 143

[56] References Cited

U.S. PATENT DOCUMENTS

| | | | |
|---|---|---|---|
| 1,874,145 | 8/1932 | Van Cura | 2/132 |
| 2,110,525 | 3/1938 | Kass | 2/132 |
| 2,442,294 | 5/1948 | King | 2/132 |
| 2,487,284 | 11/1949 | Thomas | 2/132 |
| 2,503,966 | 4/1950 | Newman | 2/132 |
| 3,200,413 | 8/1965 | Vaughan | 2/60 |
| 3,686,692 | 8/1972 | Snare et al. | 2/132 |
| 4,106,122 | 8/1978 | Dodd | 2/104 |
| 4,558,469 | 12/1985 | Richter | 2/132 |
| 4,653,119 | 3/1987 | Kaiser | 2/60 |

*Primary Examiner*—Werner H. Schroeder
*Assistant Examiner*—Jeanette E. Chapman
*Attorney, Agent, or Firm*—Wolf, Greenfield & Sacks

[57] ABSTRACT

A decorative shirt collar support device preferably in combination with a decorative clip. The support device includes a support band adapted to be positioned under the collar. The decorative clip has a base and, integral therewith, opposing legs having upper free ends that are adapted to be disposed closely adjacent to each other forming a deflectable gap in which the shirt collar may be inserted. A sliding member is adapted for use with the clip and also has a leg adapted to be received by the clip and an inner leg that may preferably have a sticky back substance for attachment to the shirt.

23 Claims, 6 Drawing Sheets

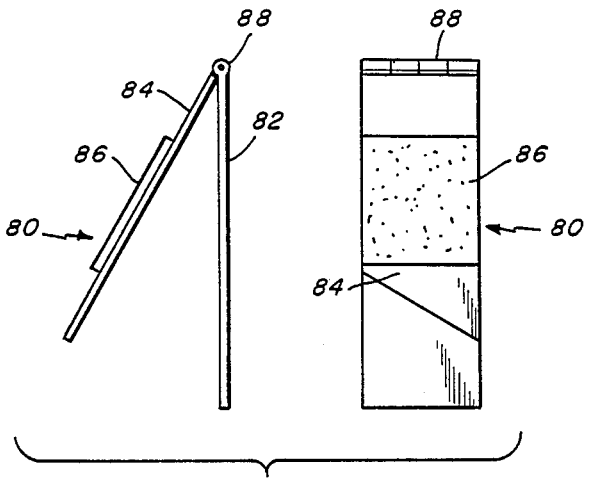
Fig. 10
Fig. 11
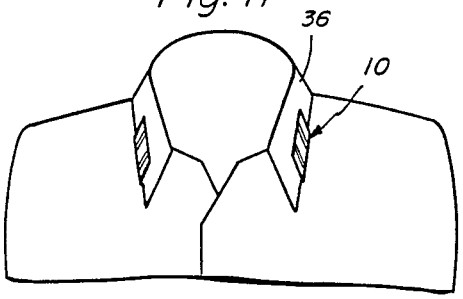
Fig. 12
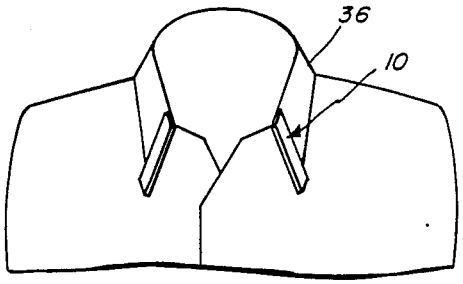
Fig. 13
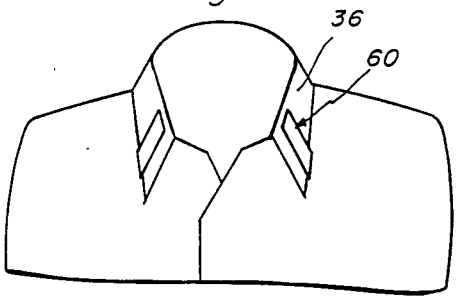

DECORATIVE SHIRT COLLAR SUPPORT DEVICE

RELATED APPLICATION

An application related to the instant invention is described in U.S. Ser. No. 06/862662 filed May 13, 1986, and now abandoned.

BACKGROUND AND SUMMARY OF THE INVENTION

The present invention relates in general to a decorative shirt collar support device and relates furthermore to a shirt collar plastic decorating product. The present invention also relates to a plastic shirt collar decorating clip that is removably retained in a simple manner on the shirt collar.

An object of the present invention to provide a decorative shirt collar support device that is adapted to provide proper shirt collar support while preferably at the same time providing a decorative effect.

A further object of the present invention is to provide a decorative shirt collar support device that is adapted for support under the collar and that is furthermore adapted for removable securing thereto.

Still another object of the present invention is to provide a plastic shirt collar decorating product having means associated therewith for providing desired positioning of the shirt collar.

A further object of the present invention is to provide a plastic shirt collar decorating product that positions the collar in a readily adjustable manner.

To accomplish the foregoing and other objects, features and advantages of the invention there is provided a decorative shirt collar support device that is comprised of a support band generally of U-shape and having the free ends thereof formed in a converging or tapered manner so as to support the collar as well as to position the collar properly. The support band is adapted for positioning under the collar. Associated with the support band is a plastic decorating clip that preferably has a base and opposing legs integrally formed with the base. The legs are adapted to be closed at their ends but are deflectable so that the clip may be inserted over the collar preferably at the front side thereof. There is a clip associated with each collar. Once these clips are inserted on the collar, capturing the ends of the band, the band may be adjusted relative to the clips for proper positioning under the collar. A decorative pattern is preferably provided on the outer surface of one or both legs of the decorative clip.

In accordance with one embodiment of the invention described herein, the plastic shirt collar decorating clip may receive, in combination therewith, a slide member having one leg adapted to fit in the clip extending upwardly from and a further leg carrying adhesive means for attachment to the shirt under the collar. The shirt collar decorating clip preferably has a guide means for receiving said slide member. The slide member is preferably adjustably positioned in the guide means so that the slide member can assume any one of a number of different positions relative to the clip.

In another embodiment of the present invention the plastic shirt collar decorating product may be in the form of a V-shaped clip that has one side exposed which is the decorative side and has the other side extending under the collar. In this embodiment of the invention a sticky substance is applied to the back side of the portion of the clip under the collar so as to retain the clip in place.

BRIEF DESCRIPTION OF THE DRAWING

Numerous other objects features and advantages of the invention should now become apparent upon a reading of the following detailed description taken in conjunction with the accompanying drawings, in which:

FIG. 10 is a schematic diagram illustrating an alternate embodiment of the slide member in which portions thereof are hinged;

FIGS. 11–13 illustrate different forms of the plastic shirt collar decorating product of this invention as illustrated specifically attached to a shirt collar;

DETAILED DESCRIPTION

Figure 1A:
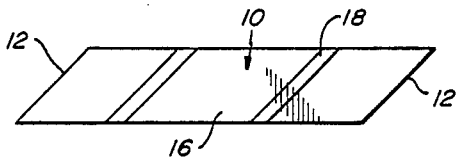
FIGS. 1A and 1B illustrate a first embodiment of the plastic shirt collar decorating product of the present invention.
Figure 1B:
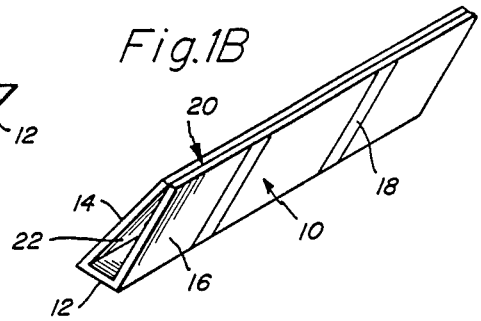

Reference is now made to FIG. 1A which is a side view and the related FIG. 1B which is a perspective view of a first embodiment of the present invention in the form of a plastic shirt collar decorating clip 10. In this particular embodiment it is noted that the ends are cut at an angle as illustrated at 12 at both ends of the clip. The clip is basically comprised of a base 12 and integral therewith, opposing upstanding legs 14 and 16. FIGS. 1A and 1B show one of the legs 16 having a decorative stripe as illustrated at 18.

FIG. 1B clearly illustrates the manner in which the legs 14 and 16 converge toward each other as they extend from the base 12 so as to provide a substantially triangular cross-section. The legs 14 and 16 terminate at their top end adjacent to each other. Because the product is preferably made of plastic and is preferably formed in an extrusion the legs 14 and 16 are deflectable so that the plastic shirt collar decorating clip may be inserted over a shirt collar. The shirt collar would of course slip into the space between the legs 14 and 16 such as illustrated at 22 in FIG. 1B.

Figure 2A:
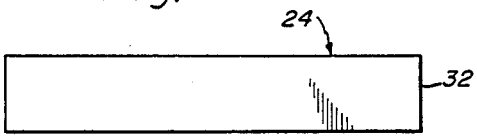
FIGS. 2A and 2B illustrate a second embodiment of the present invention similar to that illustrated in the first embodiment.
Figure 2B:
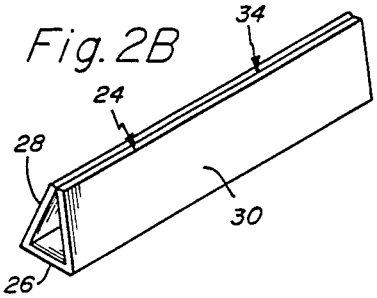

FIGS. 2A and 2B show a second embodiment of the present invention in the form of a clip 24 that also has a base 26 and, integral therewith, opposing legs 28 and 30. In this embodiment it is noted that the ends such as at 32 in FIG. 2A are square rather than angled as illustrated in FIG. 1A. In this embodiment, as in the embodiment in FIGS. 1A and 1B, the legs 28 and 30 at their upper free end are disposed adjacent to each other. Again, in this embodiment the legs 28 and 30 may be flexed outwardly at their top end so as to engage the collar in the gap 34. When the legs are then released there is a biasing force imposed between the upper free ends of the legs which enables the clip to thus be retained in fixed position on the collar. In this regard you are referred to FIG. 11 which shows the plastic shirt collar decorating product 10 of FIGS. 1A and IB disposed on a shirt collar 36. Reference may also be made to FIG. 12 which likewise shows a clip 10 that may have a solid color design thereon and that is adapted to clip at the front edge of the collar 36 rather than along the peripheral edge of the collar as illustrated in FIG. 11.

Thus, it is noted that any embodiments of FIG. 1A and 1B as well as in the embodiment of FIGS. 2A and 2B the plastic member is formed so that it will have a spring effect which enables it to be spread so that one is able to clip the product onto a shirt collar. The spring effect will hold the product on the collar.

Figure 3:
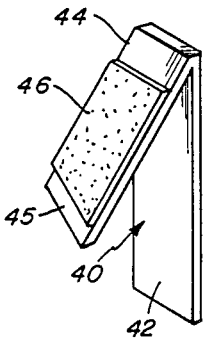
FIG. 3 illustrates a preferred embodiment of the slide member of the present invention which is used in combination with the plastic shirt collar decorating clip.
Figure 4:
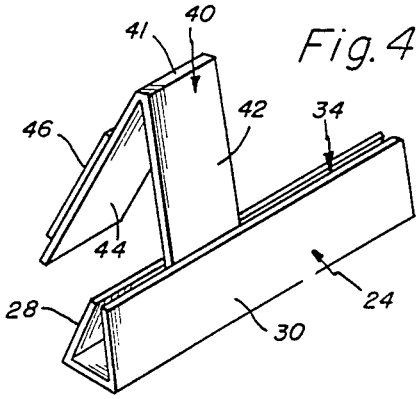
FIG. 4 is a perspective view illustrating the combination of the clip of FIGS. 2A and 2B with the slide member of FIG. 3.

Reference is now made to FIG. 3 which shows a slide member 40 that is comprised of an upright leg 42 and an angled leg 44. The slide member 40 is sort of in an inverted V-shape. The surface 45 of the leg 44 is provided with a sticky substance that may be in the form of a double sided adhesive tape as illustrated at 46 in FIG. 3. The slide member 40 is adapted to fit inside of the plastic shirt collar decorating product. In this regard, refer to FIG. 4 which shows the slide member 40 fitting inside of the plastic product in the gap 34. The slide member 40 keeps the shirt collar from flaring outward by means of the sticky substance holding the sliding member to the shirt adjacent the collar. In the embodiment illustrated in FIG. 4 the shirt collar is adapted to fit within the gap 34 and thus the leg 30 fits outside the shirt collar. The leg 42 of the slide member fits under the shirt collar and the very apex at 41 thereof would engage at the very top edge of the collar where the collar attaches back to the shirt. The other leg 44 would thus extend down the side of the shirt that is underneath the collar and that is where the sticky substance 46 would secure the slide member in place.

Figure 5:
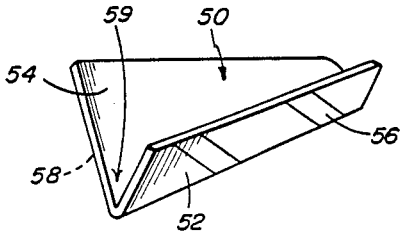
FIG. 5 illustrates an alternate embodiment of the plastic shirt collar decorating product of this invention.

Reference is now made to FIG. 5 which shows an alternate embodiment of the invention. The plastic shirt collar decorating product in this embodiment is in the form of a V-shape 50 having an outer leg 52 and an inner leg 54. As illustrated in FIG. 5 the outer leg 52 has decoration such as illustrated by the stripe at 56. Also, on the underside surface of the leg 54 there is provided a sticky substance 58. The drawing illustrated in FIG. 5 is of V-shape and the collar is adapted to fit within the space between the legs such as at 59. The leg 54 extends under the collar and of course the leg 52 fits on the outside of the collar. The particular embodiment illustrated in FIG. 5 is not adapted for use with a sliding member such as the member of FIG. 3.

Figure 6:
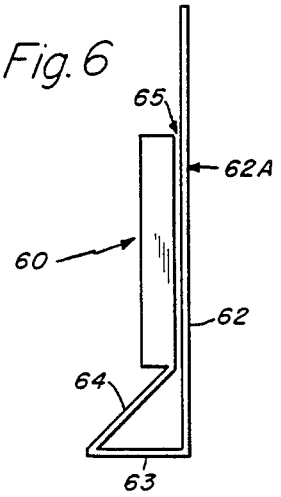
FIGS. 6 and 7 illustrate respective side elevation and perspective views of an alternate embodiment of the plastic shirt collar decorating product incorporating integral therewith a receiving or guiding means for the slide member.
Figure 7:
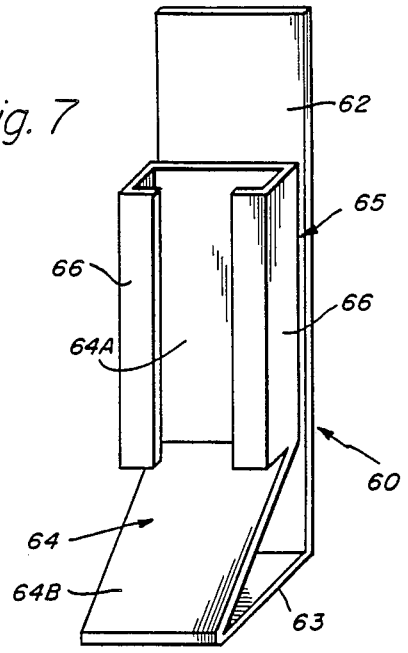

FIGS. 6 and 7 illustrate a further embodiment of the plastic shirt collar decorating product of this invention. The product 60 comprises an outer leg 62, a base 63 and a two part leg 64. The leg 64 actually includes an upper segment 64A and a lower segment 64B. It is noted that the segment 64A extends parallel with the leg 62 having a gap as illustrated at 65. The leg portion 64 extends at an angle to the base 63 as illustrated in FIGS. 6 and 7.

Figure 8:
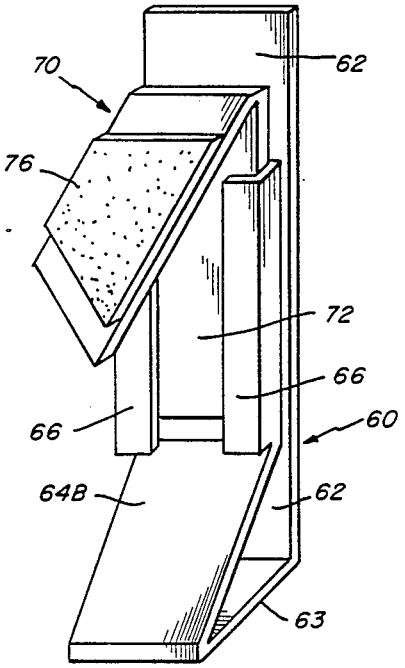
FIG. 8 is a perspective view illustrating the embodiment of FIGS. 6 and 7 and further showing the combination of the slide member with the plastic shirt collar decorating product.
Figure 9:
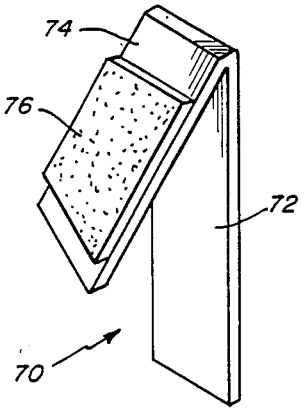
FIG. 9 is a perspective view illustrating the slide member of FIG. 8.

The portion 64A of the leg 64 includes opposed guide members 66. In this regard also refer to FIGS. 8 and 9. FIGS. 8 and 9 illustrate the slide member 70 which is similar to the member illustrated in FIG. 3 including an upright leg 72 and an inner leg 74 with the associated sticky substance as illustrated at 76 in FIG. 9.

The shirt collar is adapted to fit within the gap 65. The leg 62 fits over the outside of the shirt collar while the leg 64 with its integral guide means 66 are on the back side of the shirt collar. The shirt collar may extend fully into the product so that the bottom of the collar actually engages at the base 63 on its inside surface. The gap 65 it is noted is now an elongated gap and there is a spring effect because the product is made out of plastic between the leg 62 and the top portion 64A of the leg 64.

The slide member 70 fits in the guideway as illustrated in FIG. 8. This is preferably a force fit but one can move the slide member to any desired position. This adjustable feature is desired so that one can adjust the decorating product to the width of the particular collar with which it is said to be used. As in the embodiment of FIG. 4, the sticky substance at 76 is adapted to engage at the shirt adjacent to the collar and under the collar. In this regard, reference may be made to FIG. 13 which shows the clip 60 in position on the collar 36. It is noted in this embodiment, the clip is of elongated construction extending substantially in the opposite manner to that illustrated in FIG. 11. In the embodiment of FIG. 13 the clip 60 may have decorative matter on the outer exposed surface 62A as illustrated in FIG. 6.

Reference is now made to FIG. 10 which shows a slightly different embodiment of the present invention. FIG. 10 shows a slide member 80 having legs 82 and 84 and a sticky substance at 86. It is noted that in this particular embodiment the legs are joined at a hinge 88. This hinge would be a force fit type hinge that could be disposed in any desired position but once set in that position would be held permanently in that position. This hinging effect enables adjustment of the degree of flare of the collar. The closer the legs 80 and 82 are the less the flare and the greater they are spread the more the flare of the collar outwardly from the shirt.

Figure 14:
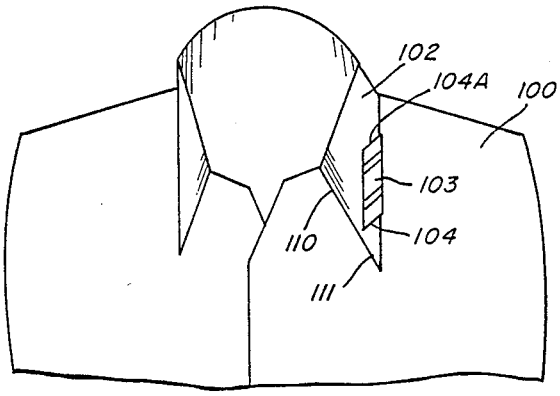
FIG. 14 illustrates an alternate form of decorative clip.
Figure 15:
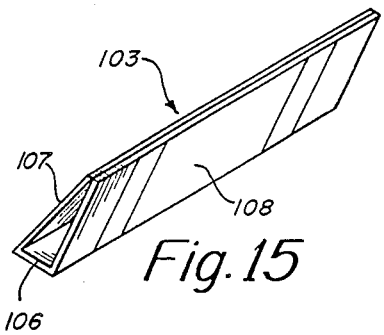
FIG. 15 is a perspective view of the clip of FIG. 14.
Figure 16:
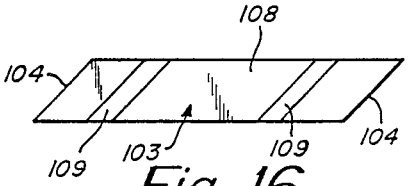
FIG. 16 is a side view of the decorative clip of FIG. 14.
Figure 17:
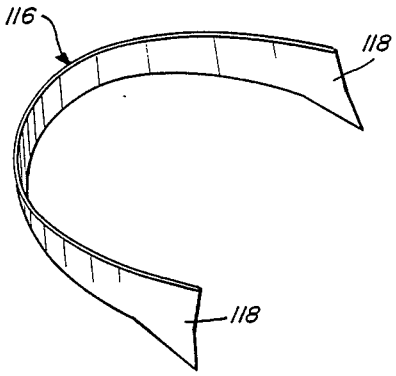
FIG. 17–19 illustrate a support band of the present invention.

Reference is now made to FIGS. 14–16 for an illustration further embodiment of the present invention. There is shown a shirt 100 having a collar 102 with a decorative clip 103 secured thereon. FIGS. 15–16 show the decorative clip 103. In this particular embodiment, it is noted that the ends 104 are cut at an angle such as the approximate 45 degree angle illustrated in FIG. 16. The clip is basically comprised of a base 106 and integral therewith, opposing upstanding legs 107 and 108. FIGS. 15 and 16 show one of the legs 108 having decorative strips as illustrated at 109. It is noted that the decorative strips extend at the same angle as the ends 104.

It is furthermore noted in the embodiment of FIG. 14 that the decorative clip 103 is supported in a manner essentially opposite to that illustrated in, for example, FIG. 11 herein. In other words the ends 104, rather then being substantially parallel to the front collar edge 110, are instead substantially at a right angle or normal to the edge 110. Again, reference may be made to FIG. 14 and the illustrated end 104 of the clip and its relationship relative to the front collar edge 110.

There is a substantial advantage in employing the clip 103 in the position illustrated in FIG. 14. When inserting the clip, at the edge 104A, as illustrated in FIG. 14, it is noted that the base will enter the very tip 111 of the collar as the clip is being secured and initially engaged with the tip 111 of the collar. This makes it far easier to engage the clip with the collar. It is preferred to have the tip of the collar enter the base of the decorative clip first and in that way the clip can be gradually brought into engagement with the collar. When the decorative clip is inserted in the manner illustrated in FIG. 11 then the end of the clip opposite to the base or in other words the area adjacent to the apex of the triangular configuration engages the collar first thus requiring the clip to be spread. On the other hand, when the clip is in the position illustrated in FIG. 14, because the collar engages at the base of the clip first then the engagement of the decorative clip with the collar is carried out far more easily and efficiently.

Reference is now made to FIGS. 17–20 for a preferred form of the invention that now incorporates a support band 116 that is substantially of a U shape as illustrated. The band 116, as well as the aforementioned decorative clip 103 may be constructed of a flexible plastic material. The band 116 is of relatively thin plastic material that enables it to be bent quite easily and can be bent into the preferred shape herein, and by heat forming retained in that shape. The shape is illustrated, for example, in FIG. 19 in which the very ends at 118 are formed in a converging manner to provide a flare to the shirt collar when the support band is disposed under the shirt collar. This flare is illustrated by the angular configuration as plotted along line A in FIG. 19.

Figure 18:
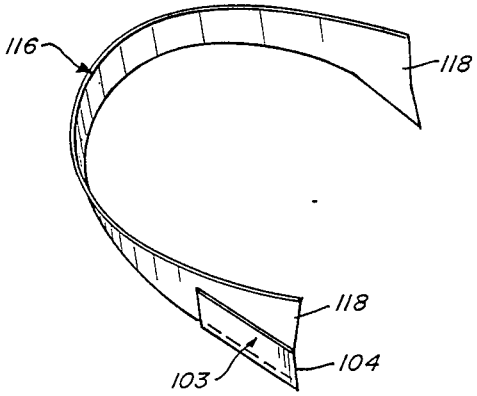
Figure 19:
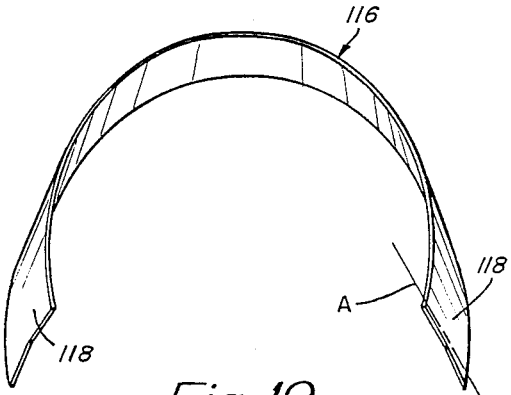
Figure 20:
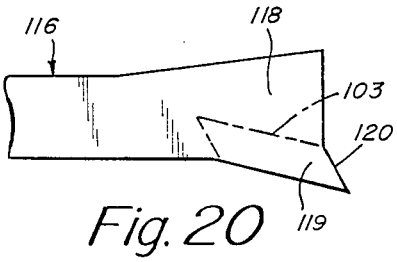
FIG. 20 is a fragmentary view of the configuration of the very end, at one end of the support band illustrated in FIG. 17–19.

FIG. 20 herein shows the specific configuration at the end 118 in which there is provided a wing 119 that has a front edge 120 that is adapted to essentially match the edge of the securing clip such as the edge 104 of the clip 103 illustrated in FIG. 18. Also note the securing clip is shown in dotted outline at 103 in FIG. 20.

Figure 21:
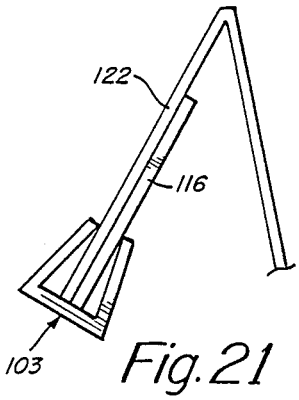
FIG. 21 is a fragmentary end view showing the decorative clip and support band on a collar.
Figure 22:
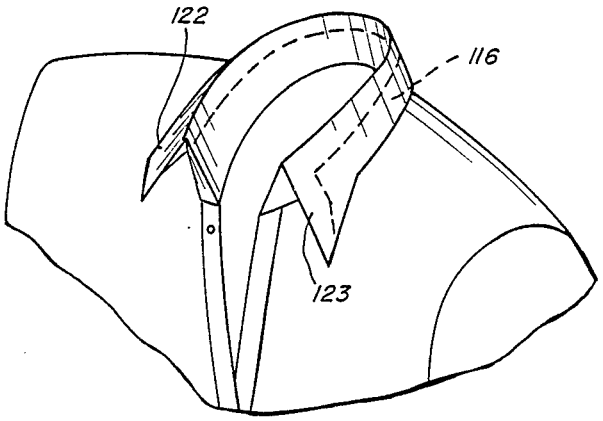
FIG. 22 is a perspective view illustrating a shirt collar with the support band shown in dotted outline under the collar.
Figure 23:
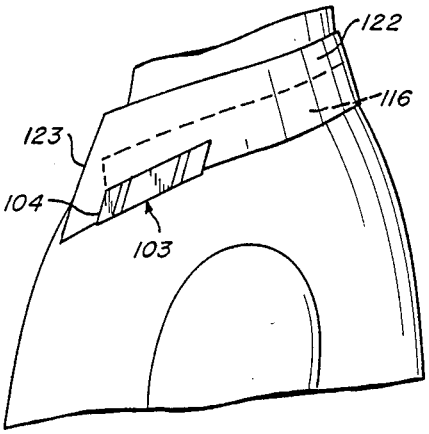
FIG. 23 is an illustrative side view showing a shirt collar with the decorative clip in place and furthermore illustrating the support band under the collar in dotted outline.

Reference is now made to FIGS. 21–23 for further illustrations of the combination of the support band as illustrated in FIGS. 17–20 and the decorative clip as illustrated in FIGS. 14–16.

FIG. 21 is an end view illustrating the collar 122, the decorative clip 103 and the support band 116.

FIG. 22 illustrates the collar 122 and furthermore illustrates the support band 116 thereunder. In FIG. 22 because the support band is not visible it is shown in dotted outline. However, its basic position under the collar is clearly illustrated in FIG. 22. In this regard it is noted that the support band 116 terminates short of the front edge 123 of the collar but it is preferred that a space be left between the end of the support band and the front edge of the collar that may be approximately one-half to one inch on either side.

FIG. 23 is a side view furthermore illustrating the decorative clip 103 in place retaining the collar 122 while at the same time also engaging and holding the support band 116.

The basic technique for employing the support band and decorative clip of the present invention is to first dispose the support band under the collar generally in the proper position. The clips 103 are then inserted on either side and in the particular position illustrated in FIG. 23 it is noted that the edge 104 is disposed to be parallel with the front edge 123 of the collar. It is also noted that, once the clip is in proper position, the support band can be adjusted relative thereto so that the support band is symmetrically disposed under the collar, such as in the manner illustrated in FIG. 23. By engaging the edge 104 with the edge 120 of the support band (refer to FIG. 20), then the support band can be properly positioned relative to the collar. The decorative clips are also preferably symmetrically disposed so that they are in the proper position such as that illustrated in FIG. 27 herein. The decorative clips as well as the ends of the support band are disposed symmetrically in the collar, as mentioned, and this means that there is basically the same space between the front ends thereof and the front edge of the collar on either of the collar sides.

Figure 24:
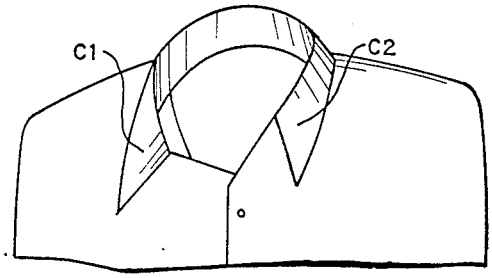
FIGS. 24–26 show three illustrations of a shirt showing how the collar can be displaced when unsupported.
Figure 25:
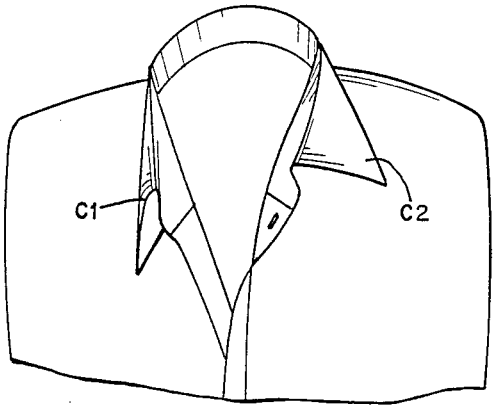
Figure 26:
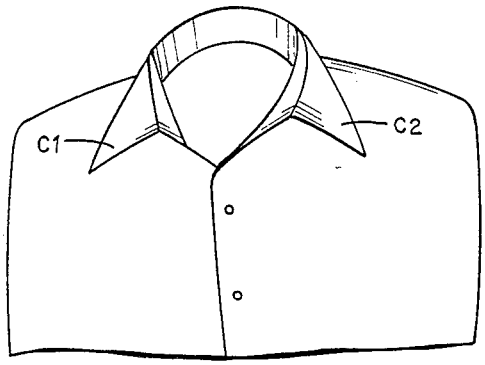
Figure 27:
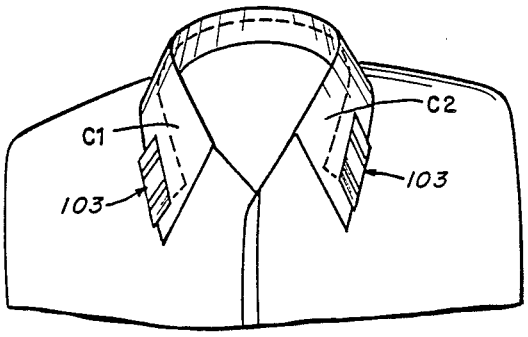
FIG. 27 illustrates a shirt and shirt collar with the decorative clip and band in place under the shirt collar and illustrated on the collar holding the shirt collar in its desired and proper position.

Reference is now made to FIG. 24–27 herein. FIGS. 24–26 are shown for the purpose of illustrating the manner in which shirt collars can be displaced when not properly supported. In FIGS. 24–27 there are shown the collars C1 and C2. FIGS. 24–26 show the different manners that the respective collars can be displaced out of proper position. On the other hand, FIG. 27 illustrates the collars C1 and C2 when the support band and associated decorative clip are employed for proper support of the collar as well as providing the proper flare to the collar such as is clearly illustrated in FIG. 27.

Figure 28:
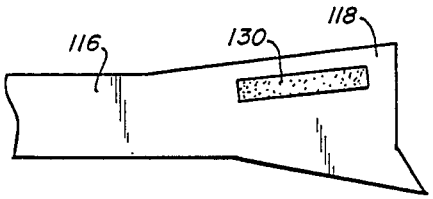
FIG. 28 is a fragmentary view of an end of the support band showing the alternative application of a sticky substance.
Figure 29:
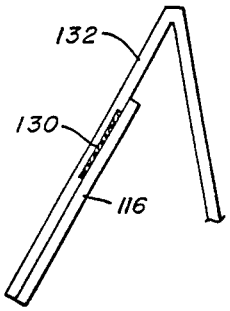
FIG. 29 is an end view illustrating the manner in which the band is positioned with the sticky back substance secured under the collar and not dependent on the clip but used without the clip.
Figure 30:
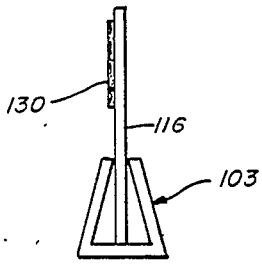
FIG. 30 shows another alternative of the support band with the sticky back substance and the securing clip.

Reference is now made to FIGS. 28–31 for a further feature of the present invention in which there is employed on the support band 116 a sticky back substance illustrated at, for example, 130 in FIG. 28. Also note the view of FIG. 30 wherein the decorative clip 103 is shown engaged with the band 116. FIG. 30 also illustrates the sticky back substance 130 which may be a double sided tape, for example.

Figure 31:
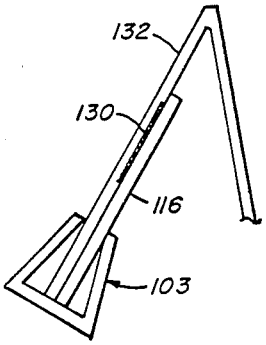
FIG. 31 is an end view showing the entire assembly of support band and decorative clip as attached to a collar.

FIGS. 29 and 31 also further illustrate the product in association with a shirt collar 132. These views illustrate the sticky back substance 130 against the inside of the collar 132 for assisting in retaining the support band 116 in place under the collar. The sticky back substance 130 holds the band at one position further up the collar while the decorative clip 103 holds the support band at a lower position against the collar 132.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. In combination, a plastic shirt collar decorating clip and a shirt collar upon which the clip is to be positioned, said clip comprising a base and opposing legs, said base being integrally formed with said opposing legs, said opposing legs and base forming an interior chamber that is substantially triangular in cross-section, said opposing legs having upper free ends that are adapted to converge forming a relatively thin gap therebetween, said legs being defectable for the purpose of receiving the shirt collar therebetween, said legs providing a spring effect enabling the clip to be secured in place on the shirt collar, the outer surface of at least one of said legs having a decorative indicia thereon, said shirt collar fitting through said gap into said interior chamber with the legs' free ends at said gap engaging the shirt collar at a position inward of the shirt collar edge, said legs both of substantially solid and rigid construction and of fixed unextendable length, one of said legs disposed under said collar and the other one of said legs disposed over said collar, in combination with a sliding member having opposite legs with one of said legs adapted to fit inside of the clip legs, said sliding member being of V-shape with a front leg received in the clip and a rear leg attached behind the collar, wherein both legs of the sliding member are disposed behind the shirt collar with said one leg of the sliding member held in position in said gap, said shirt collar being disposed in said gap on the outside of said one leg of the sliding member.

2. The combination as set forth in claim 1 wherein the ends of the legs are cut at an angle.

3. The combination as set forth in claim 1 wherein the ends of the legs are cut square.

4. The combination as set forth in claim 5 wherein both clip legs are of substantially the same size and shape.

5. In combination, a plastic shirt collar decorating clip and a shirt collar having a shirt collar edge upon which the clip is to be positioned, said clip comprising a base and opposing legs, said base being integrally formed with said opposing legs, said opposing legs and base forming an interior chamber that is substantially triangular in cross section, said opposing legs having upper free ends that are adapted to converge forming a relatively thin gap therebetween said legs being for the purpose of receiving the shirt collar therebetween, said legs providing a spring effect enabling the clip to be secured in place on the shirt collar, the outer surface of at least one of said legs having a decorative indicia thereon, said shirt collar fitting through said gap into said interior chamber with the legs' free ends at said gap engaging the shirt collar at a position inward of the shirt collar edge, said legs both of substantially solid and rigid construction and of fixed unextendable length, one of said legs disposed under said collar and the other one of said legs disposed over said collar.

6. The combination as set forth in claim 5 wherein the ends of the legs are disposed at an acute angle to said base.

7. The combination as set forth in claim 6 wherein the end of the clip is disposed along a line parallel to the front edge of the collar.

8. The combination as set forth in claim 6 wherein the end of the clip is disposed along a line normal to the front edge of the shirt collar.

9. The combination as set forth in claim 6 and further including, in combination, a sliding member having opposite legs with one of the legs adapted to fit inside of the clip legs.

10. The combination as set forth in claim 9 including a sticky substance on the back side of the other leg of the sliding member.

11. The combination as set forth in claim 10 wherein the sliding member that fits inside the clip maintains the shirt collar from flaring outwards by means of the sticky substance holding the sliding member to the shirt under the collar when the sliding member is retained inside of the clip.

12. The combination as set forth in claim 6 wherein the legs of the product include an outside leg and an inside leg and wherein the inside leg is formed in two parts including an angled lower part and an upper part that extends substantially in parallel to the outer leg, a slide member and a guide means on the inner leg for receiving said slide member, said slide member being adjustable in the guide means so as to provide adjustment between the sliding member and the decorating clip.

13. The combination as set forth in claim 6 in further combination with a support band adapted for positioning under the collar and retained in place by means of the decorating clip.

14. The combination as set forth in claim 13 wherein said support band comprises a thin plastic band of substantially U-shape having free ends thereof extending in a manner to provide a symmetric flare to the collar.

15. The combination as set forth in claim 14 wherein the band has at its free ends a wing with a taper matching that of the end of the clip.

16. The combination as set forth in claim 14 including a sticky back substance on the support band for assisting in retaining the support band on the inside of the collar.

17. In combination, a decorative shirt collar support device comprised of a U-shape support band adapted for being disposed under a shirt collar, and a support clip having a base and opposed upstanding legs, the base being integrally formed with the opposing legs, the opposing legs having upper free ends that are adapted to converge forming a relative thin gap therebetween, said legs being deflected for the purpose of receiving the collar therebetween.

18. The combination as set forth in claim 17 wherein the support clip has acute angle ends with the support band having free ends that are adapted to be received by the support clip, the ends of the support band having a wing adapted to matching the configuration of the acute ends of the support clip, said support clip at each collar having the acute end thereof disposed to extend substantially orthogonal to the front edge of the shirt collar.

19. The combination as set forth in claim 17 including a sticky back substance on the support band on the side facing the shirt collar so as to assist in holding the support band in proper position on the shirt collar.

20. The combination as set forth in claim 17 wherein the opposing legs of the base along with the base form an interior chamber that is substantially triangular in shape, said legs providing a spring effect enabling the clip to be secured in place on the shirt collar, the outer surface of at least one of said legs having a decorative indicia thereon, said shirt collar fitting through said gap into said interior chamber the leg's free ends at said gap engaging the shirt collar at a position inward of the shirt collar edge, the legs both of substantially solid and rigid construction and affixed unextendable length, one of the legs disposed under the collar and the other of the legs disposed over the collar, the ends of the decorative clip disposed at an acute angle to the base, the ends of the clip being disposed substantially orthogonal to the front edge of the shirt collar so as to assist in insertion of the clip on the collar, the front edge of the collar engaging the base of the clip upon insertion of the clip on the collar and decorative indicia extending in a direction substantially parallel to the opposed edges of the support clip.

21. The combination as set forth in claim 17 wherein said support band is slidable relative to said support clip for the positioning thereof.

22. The combination as set forth in claim 5 further including a support band having free ends, said support band adapted to fit inside the clip to maintain the shirt collar from flaring outwards.

23. The combination as set forth in claim 22 wherein said support band has a sticky substance located on said band used to maintain the shirt collar from flaring outwards, by means of said sticky substance holding the collar against the support band located under the collar.

* * * * *